US007806353B2

(12) United States Patent
Douglas et al.

(10) Patent No.: US 7,806,353 B2
(45) Date of Patent: Oct. 5, 2010

(54) CRUSHER APPARATUS

(75) Inventors: Paul Douglas, Derbyshire (GB); Terence Bratton, County Tyrone (GB)

(73) Assignee: Extec Screens and Crushers Limited, Derbyshire (GB)

( * ) Notice: Subject to any disclaimer, the term of this patent is extended or adjusted under 35 U.S.C. 154(b) by 312 days.

(21) Appl. No.: 11/568,305

(22) PCT Filed: Apr. 12, 2005 (Under 37 CFR 1.47)

(86) PCT No.: PCT/GB2005/001411

§ 371 (c)(1), (2), (4) Date: Oct. 19, 2007

(87) PCT Pub. No.: WO2005/099903

PCT Pub. Date: Oct. 27, 2005

(65) Prior Publication Data

US 2008/0245915 A1 Oct. 9, 2008

(30) Foreign Application Priority Data

Apr. 16, 2004 (GB) ..... 0408594.0

(51) Int. Cl.
*B02C 21/02* (2006.01)

(52) U.S. Cl. ..... 241/101.74

(58) Field of Classification Search ..... 241/101.74, 241/101.741, 101.75, 101.76, 186.3, 186.35, 241/101.5
See application file for complete search history.

(56) References Cited

U.S. PATENT DOCUMENTS

| | | | | |
|---|---|---|---|---|
| 2,515,165 | A * | 7/1950 | Siems | 241/186.3 |
| 2,554,575 | A | 5/1951 | Kurtz et al. | |
| 3,226,043 | A * | 12/1965 | Bowman | 241/223 |
| 3,655,039 | A | 4/1972 | Kind et al. | |
| 3,752,409 | A * | 8/1973 | Lewis | 241/60 |
| 4,433,813 | A * | 2/1984 | Whatton et al. | 241/21 |
| 4,478,372 | A * | 10/1984 | Paterson et al. | 241/35 |
| RE31,818 | E * | 1/1985 | Clonch | 241/101.74 |
| 5,361,996 | A * | 11/1994 | Svensson et al. | 241/30 |
| 7,182,284 | B2 * | 2/2007 | Jabs et al. | 241/101.74 |
| 7,293,727 | B2 * | 11/2007 | Moriya et al. | 241/101.74 |
| 7,325,759 | B2 * | 2/2008 | Meyer | 241/30 |
| 2003/0029946 | A1 * | 2/2003 | Lieber et al. | 241/34 |
| 2003/0141394 | A1 * | 7/2003 | Ueda et al. | 241/73 |
| 2006/0202073 | A1 * | 9/2006 | Heeszel et al. | 241/101.74 |
| 2007/0158479 | A1 * | 7/2007 | Westerman et al. | 241/101.74 |

FOREIGN PATENT DOCUMENTS

DE 3342878 A1 6/1985

* cited by examiner

*Primary Examiner*—Faye Francis
(74) *Attorney, Agent, or Firm*—Kirton & McConkie; Evan R. Witt

(57) ABSTRACT

A crusher apparatus includes a crusher device having an inlet for receiving a supply of crushable bulk material, and an outlet for discharging crushed material; and a feeder device arranged to feed the supply of bulk material to the inlet of the crusher device in which the feeder device is adjustable between an operative feeding position in which the bulk material can be supplied to the inlet of the crusher device, and an inoperative position to discharge the material, without being fed to the crusher device, e.g. when undesirable material is present in the material for supply to the crusher device.

13 Claims, 10 Drawing Sheets

CRUSHER APPARATUS

This invention relates to a crusher apparatus having a frame, a crusher device mounted on the frame and arranged to receive a supply of crushable material, and a feeder device arranged to supply the material to the crusher device.

Crushers are used in quarry and other environments to crush stone, rubble and site clearance material into smaller portions of crushed material, and the crusher device used can be a cone type crusher, a jaw type crusher, or other known types of crusher.

In the clearance of site material, it is often the case that loose or attached metal reinforcing rods, metal beams and metal fragments are incorporated in the supply of site rubble to a crusher, and it is highly undesirable for such material to pass into the workings of the crusher, which can jam and/or damage the operation of the crusher device.

Therefore, in use in particular of so-called secondary crushers, which are very prone to damage by metal, e.g. tramp material or steel reinforcements, it is usual to provide some form of metal detector which is arranged to interrupt the supply of feeder material to the crusher device whenever the presence of metal in the feeder material is detected.

This is standard equipment on crushers which are exposed to this risk, and which stops the operation of the entire crusher whilst the operator searches for and manually removes the metal contamination, before re-setting the machine, and then restarting the feeder supply and the crusher device.

A secondary crusher is a substantial piece of capital equipment, for which maximum efficiency of usage is important, and avoidance of down-time should be minimised in order to give required operating efficiency. Evidently, with existing equipment, reliance on operator monitoring, and manual removal of metal contamination after stoppage of the apparatus, before the apparatus can be restarted, can involve substantial periods of down-time of the crusher device which adversely affects operating efficiency.

The present invention seeks to solve this problem of reduced efficiency by providing a unique arrangement of feeder device for supplying material to the crusher device.

According to the invention there is provided a crusher apparatus which comprises:

a crusher device having an inlet for receiving a supply of crushable bulk material, and an outlet for discharging crushed material; and a feeder device arranged to feed the supply of material to the inlet of the crusher device:

in which the feeder device is adjustable between an operative feeding position in which the bulk material can be supplied to the inlet of the crusher device, and an inoperative position to discharge the material, without being fed to the crusher device, e.g. when undesirable material is present in the material for supply to the crusher device.

Thus, a crusher apparatus according to the invention can operate continuously to supply material to the crusher device for as long as there is no undesirable material present, but when undesirable material is indeed present, the supply to the crusher device can be briefly interrupted by discharge of the material to a suitable position sufficiently far away from the crusher inlet, e.g. to a discharge position to one side of the crusher apparatus. As soon as the undesirable material is no longer present, the feeder device is adjusted back to its feeding position and crushing can recommence.

The feeder device may also be adjusted to the inoperative position to discharge the material (without being fed to the crusher device), for reasons other than the presence of undesirable material in the supply of bulk material.

Preferably, a detector is arranged to monitor the material as it is fed to the inlet of the crusher device, and to detect the presence of any particular undesirable material, e.g. metal incorporated in a supply of site rubble. If operational personnel are required to control the operation of the crusher apparatus, it may be sufficient for the detector to issue a warning signal when the presence of undesirable material is detected in a batch of material, and an operator may then initiate adjustment of the feeder device to the inoperative position, to discharge the particular batch of material in which the undesirable material also is present. Once it is apparent that the undesirable material has been discharged, the feeder device can be re-adjusted back to its operative feeding position.

The crusher device may therefore remain operational, while undesirable material is being discharged, so that it can continue to work on material already supplied to it. The feeder device then resumes supply to the crusher device after it has been returned to the feeding position, so that there is possibly only a small reduction in output of crushed material, which improves the operating efficiency of the crusher apparatus of the invention, compared with existing machines.

If a fully automated apparatus is required, then the feeder device may be arranged to be adjusted automatically from the feeding position to the discharge position, and vice versa, when respectively undesirable material is detected, and when such material has been discharged.

The feeder device may have an input hopper to which the bulk material is supplied, and an endless conveyor to feed the material from the hopper to the inlet of the crusher device.

In order to allow gravity discharge of the material into the inlet of the crusher device, the conveyor may be an elevator which raises the material from an outlet of the hopper to un upper discharge end of the elevator. The material then falls under gravity into the inlet of the crusher device.

The crusher device may comprise a cone-type crusher, in which gravity fed material falls downwardly through the crusher device while a gyratory crushing action takes place. Other types of crusher device may be used, including a jaw crusher.

The feeder device preferably takes the form of a feeder unit adjustably mounted at a mounting position adjacent to the crusher device. Conveniently, the feeder unit is mounted on a support platform which is provided on the chassis or frame of the apparatus.

The adjustable mounting of the feeder unit preferably comprises a turntable which enables the feeder unit to carry out slewing movement between its feeding position and its discharge position.

Therefore, in a crusher apparatus according to a preferred embodiment of the invention, the presence of undesirable material in a batch of bulk material to be supplied to the crusher device, e.g. metal contaminant in site rubble, can be detected either automatically when a detector is provided, or visually under operator control, and the feeder unit is then adjusted to the discharge position to discharge the material to one side of the apparatus. After the contaminant has been discharged (as monitored by the detector or visually), the feeder unit is then adjusted back to its operative feeding position.

Therefore, upon detection of contaminants, the feeder unit will stop, rotate and discharge the batch of material with the contaminant, rotate back to the feeding position, and then continue feeding to the crusher device. This process can be performed in three ways:

1. manually by an operator sited on or at the crusher apparatus;

2. via radio control by an excavator/wheeled loader operator, or the operator of a primary crusher; and
3. automated sequence from the crusher apparatus itself.

The invention is particularly suitable for use with a cone type crusher device, and it is envisaged that on machines capable of 200 to 300 tonnes per hour of material throughput, this will enable substantial reduction in stoppage time, i.e. greatly increased efficiency, but also reducing the manpower required to operate the equipment.

Preferably, a discharge conveyor is arranged to receive and to discharge crushed material produced by the crusher device, and the endless conveyor of the feeder device and the discharge conveyor are conveniently located on opposite sides of the crusher device, as seen in plan.

A preferred embodiment of crusher apparatus according to the invention will now be described in detail, by way of example only, and taking the form of a secondary crusher machine for use in the secondary crushing of site material which has been pre-treated by a primary screening/crusher apparatus, and in which.

Figure 1:
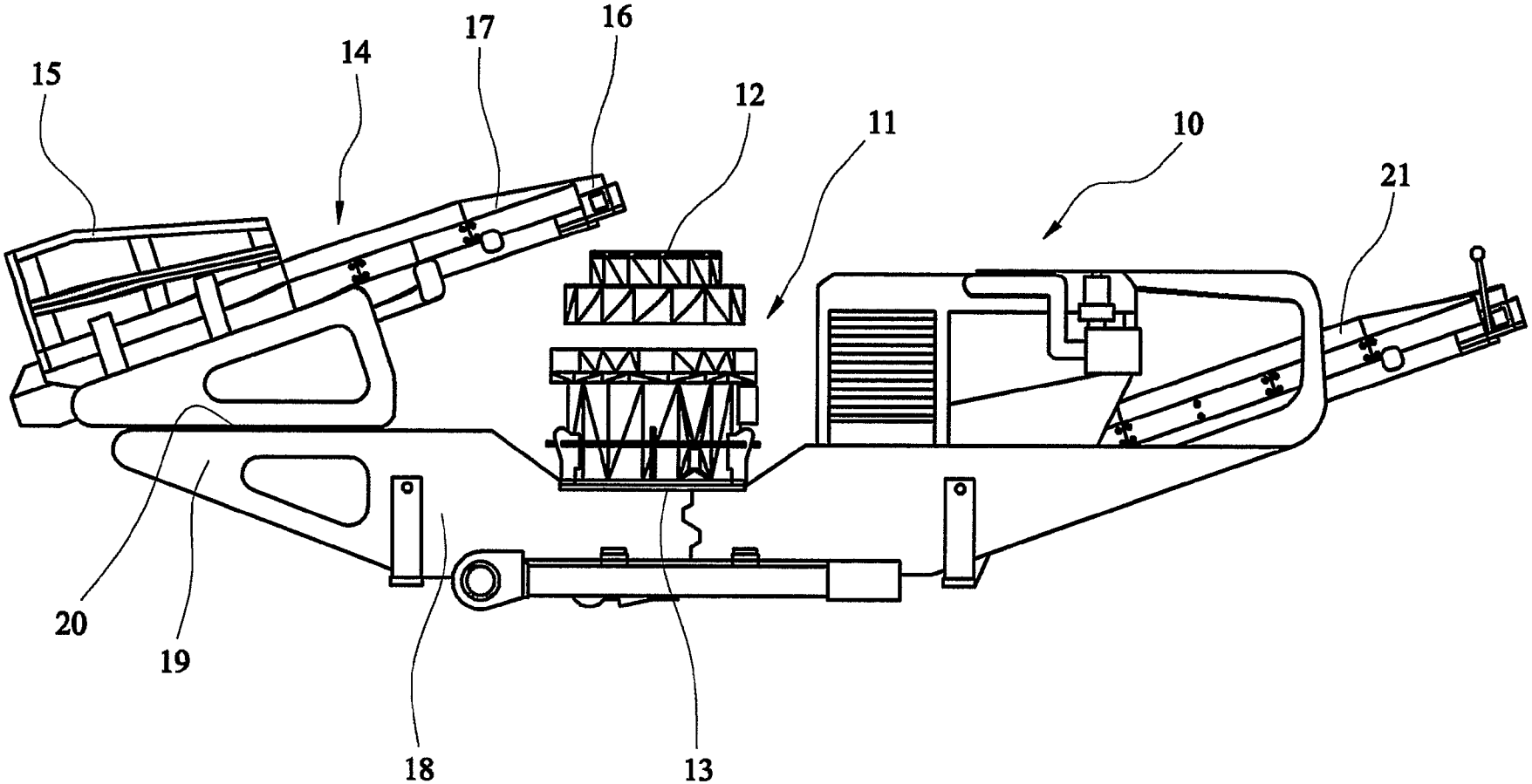
FIG. 1 is a side view of a crusher apparatus according to the invention, showing a centrally mounted cone type crusher device and a feeder device for supplying bulk material to the crusher device shown in an operative feeding position.
Figure 2:
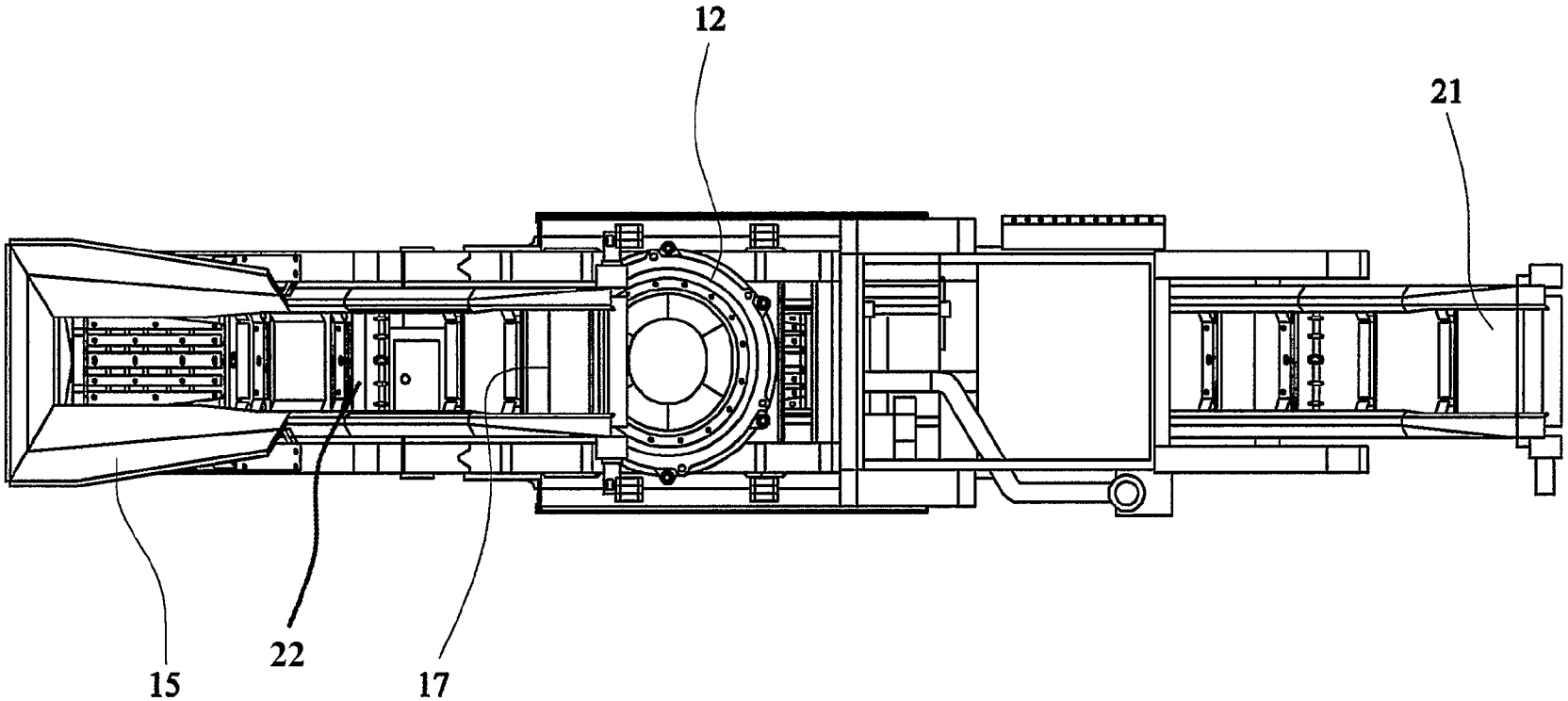
FIG. 2 is a plan view corresponding to FIG. 1.
Figure 3:
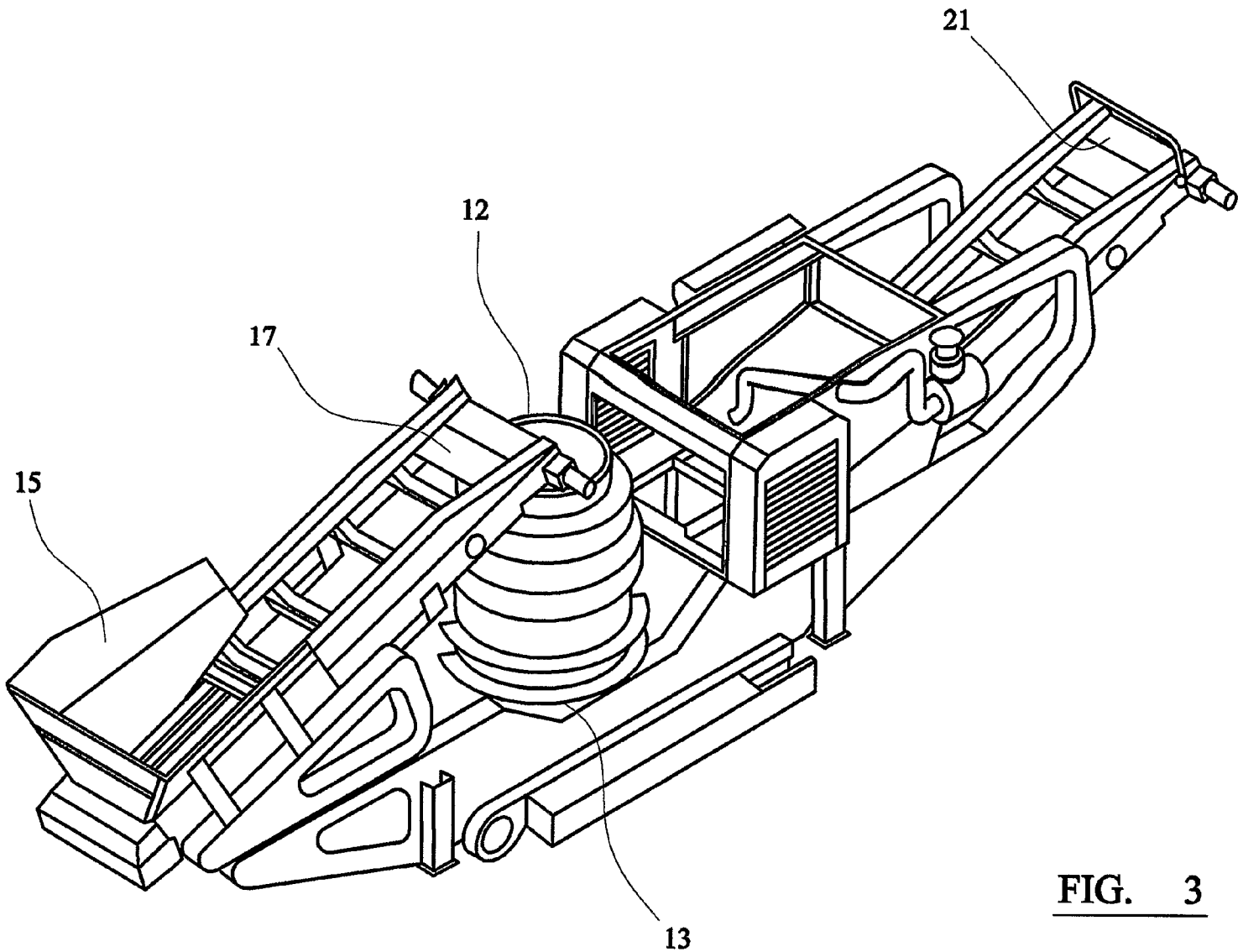
FIG. 3 is a perspective view of the apparatus showing in FIGS. 1 and 2.
Figure 4:
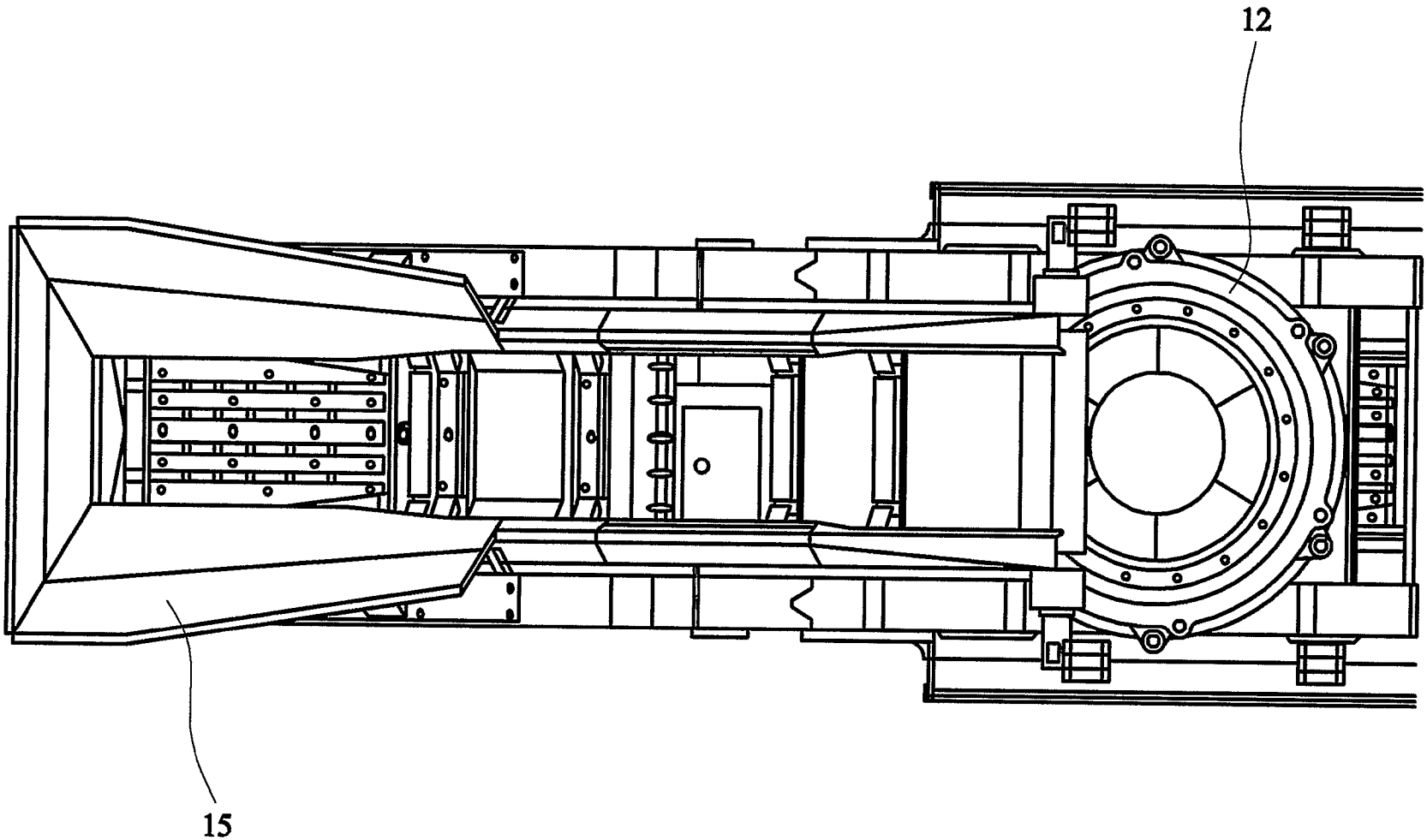
FIG. 4 is a detail plan view showing in more detail the co-operation between the feeder device and the crusher device.
Figure 5:
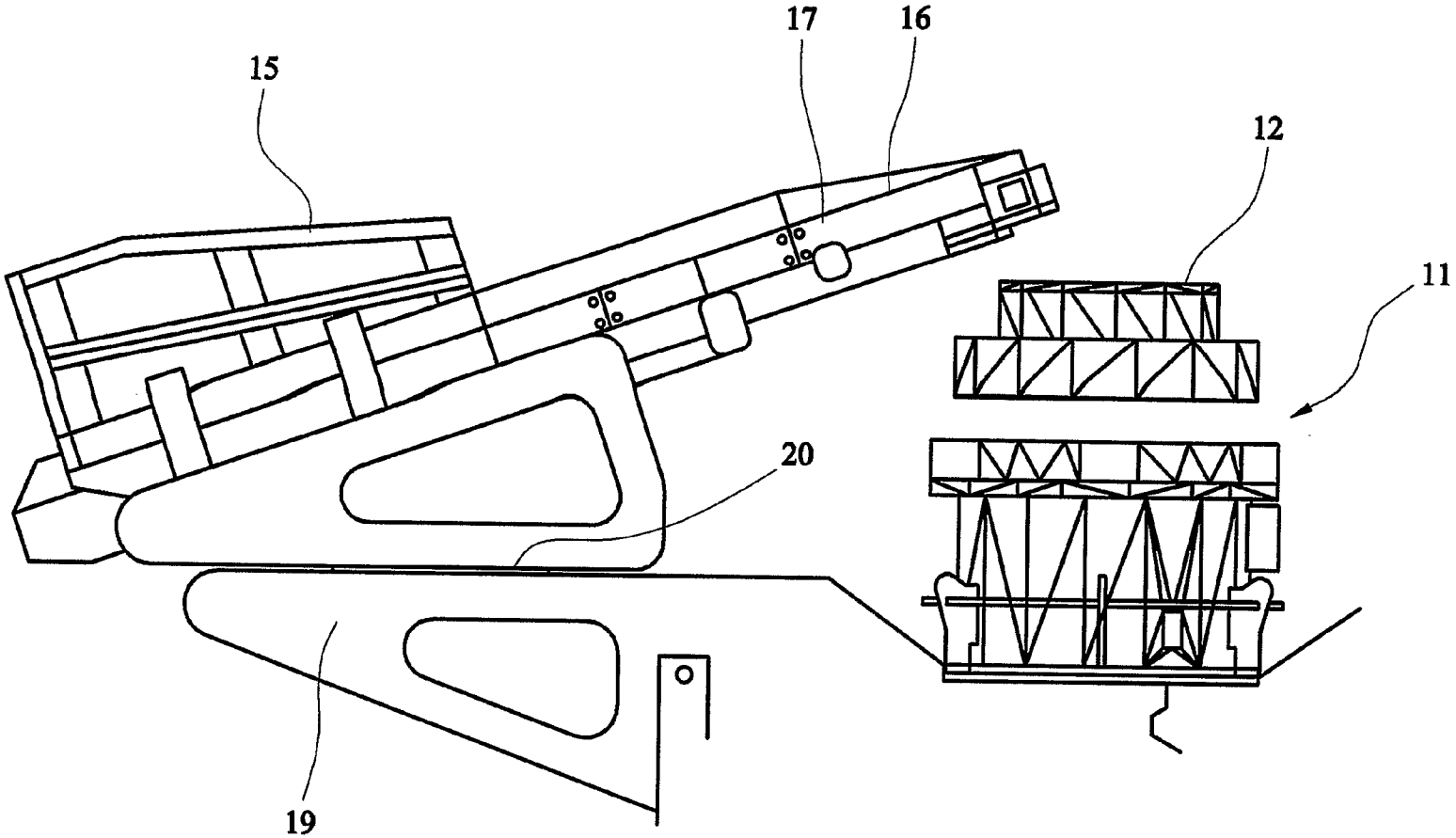
FIG. 5 is a detail side view, to an enlarged scale, showing in more detail the co-operation between the feeder device and the crusher device.

Referring now to the drawings, a crusher apparatus according to the invention is designated generally by reference 10, and has a crusher frame or chassis 18 on which is mounted a central crusher device 11 having an inlet 12 for receiving a supply of crushable bulk material, and an outlet 13 for discharging crushed material. Conveniently, though not essentially, the crusher device 11 is a cone type crusher.

A feeder device 14 is mounted on the frame 18, and is arranged to feed the supply of bulk material to the inlet 12 of the crusher device 11.

Figure 6:
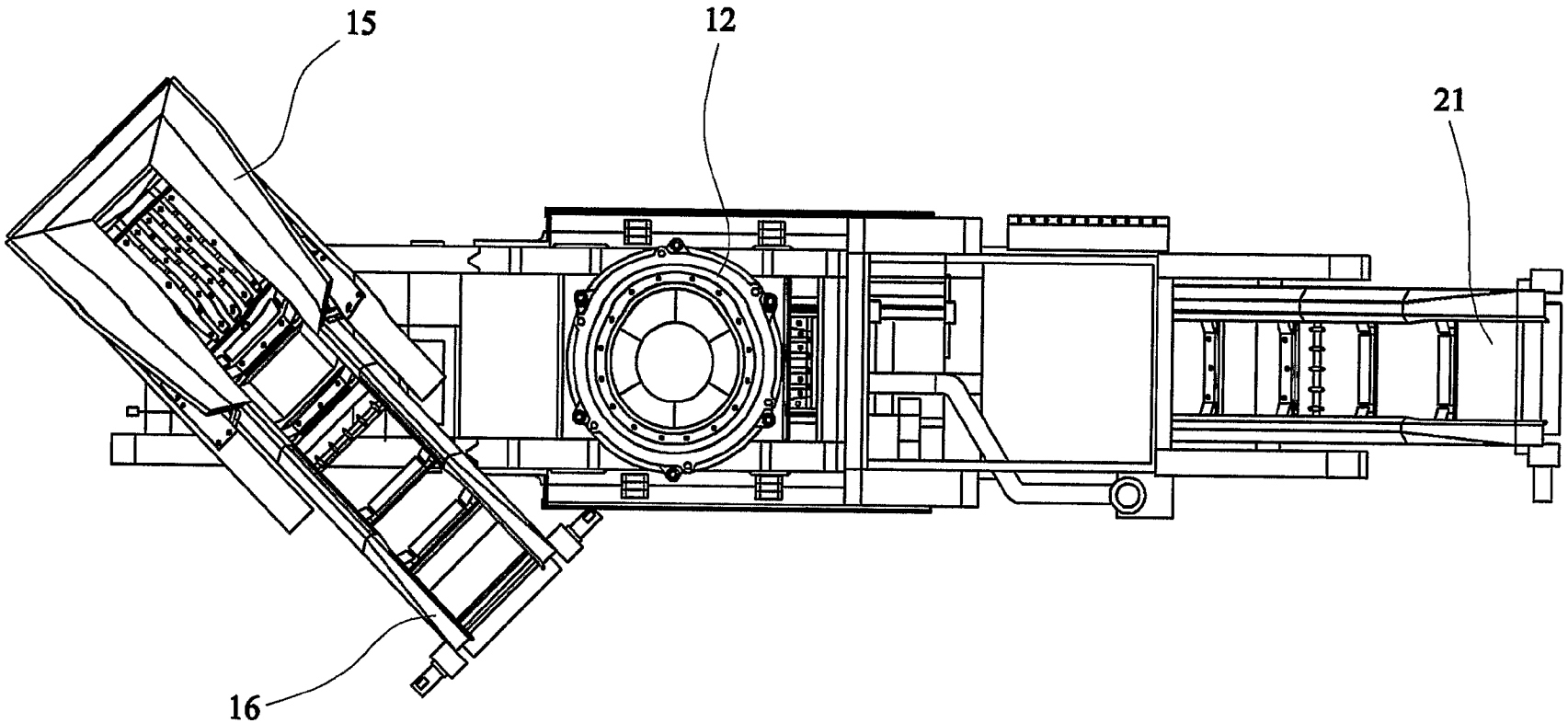
FIG. 6 is a plan view of the apparatus of FIGS. 1 to 5, but showing the feeder device adjusted to an inoperative discharge position which it takes up when the presence of undesired material in the bulk supply is detected.
Figure 7:
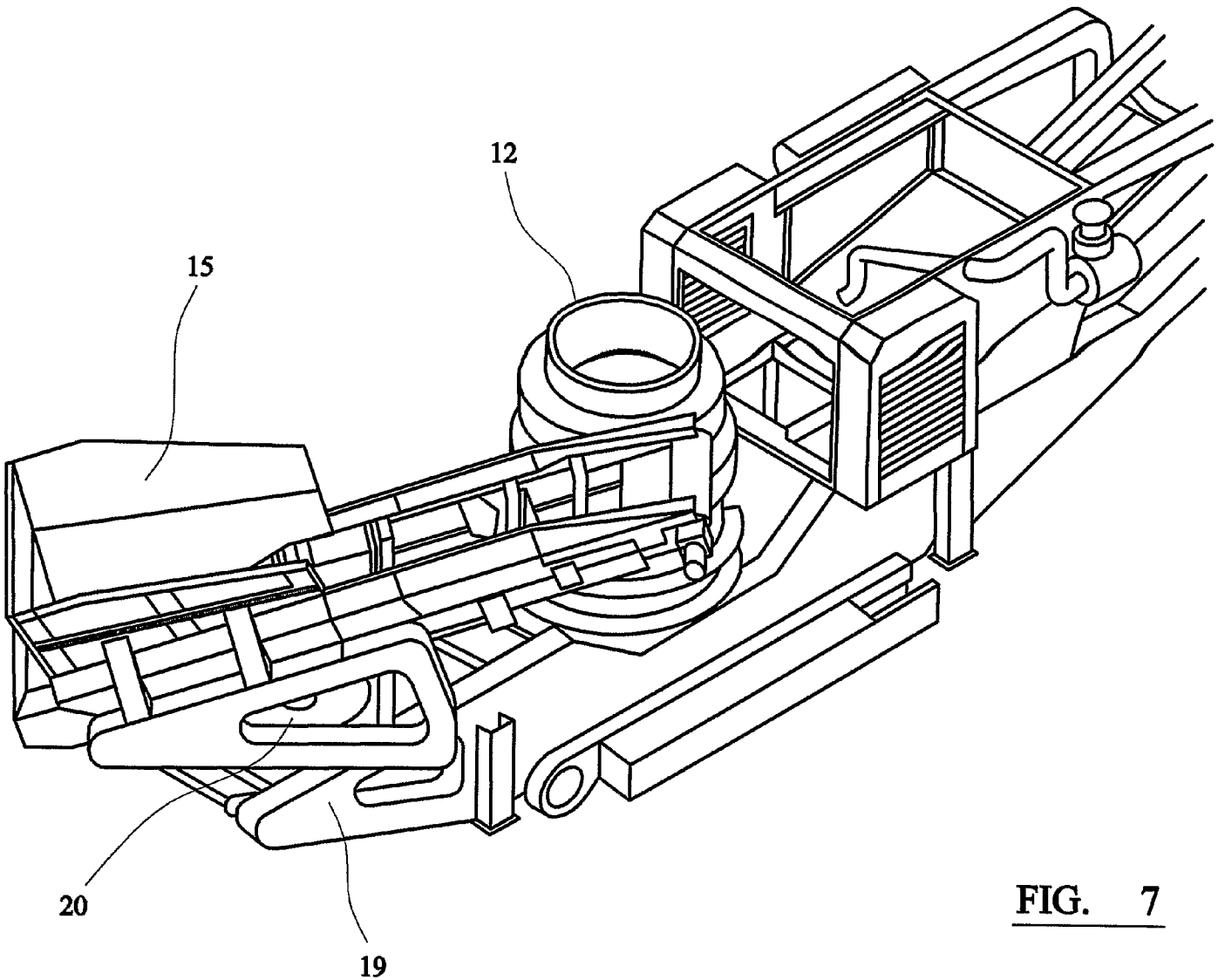
FIG. 7 is a perspective view corresponding to FIG. 6.
Figure 8:
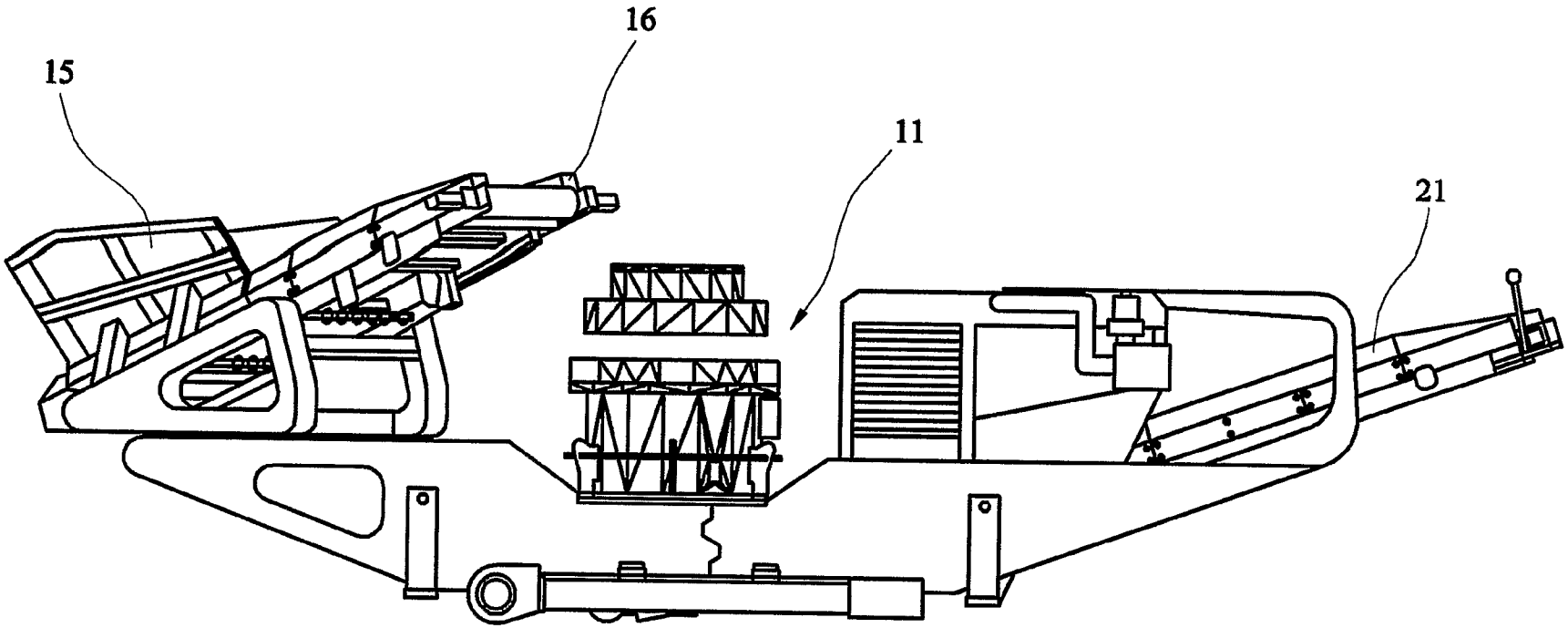
FIG. 8 is a side view of the apparatus, showing the feeder device in the inoperative discharge position.

The feeder device 14 is shown in an operative feeding position in FIGS. 1 to 5, in which the bulk material can be supplied to the inlet 12 of the crusher device 11. However, the feeder device is adjustable to an inoperative position, shown in FIGS. 6 to 8, in order to discharge the material, without being fed to the crusher device 11, when undesirable material is present in the material for supply to the crusher device 11.

The feeder device 14 has an inlet end 15 provided with a supply hopper, for receiving bulk material, and an outlet end 16 for discharging the bulk material into the mouth of the crusher device 11. Conveniently, at least the outlet end 16 of the feeder device 14 is moveable in order to adjust the feeder device between its operative position and its discharge position.

However, in the illustrated embodiment, the feeder device 14 comprises a unitary assembly which is bodily moveable in order to adjust the feeder device between the operative and discharge positions.

A detector 22 may be provided in order to monitor the material as it is being fed by the feeder device 14 to the inlet 12 of the crusher device 11, and to detect the presence of any particular undesirable material in any particular batch. In the case of site rubble, "undesirable material" would be any metal contamination, which could jam and/or damage the operation of the crusher device.

In the case of an operator controlled crushing apparatus, the detector 22 may be arranged to issue a warning signal when the presence of undesired material is detected, so that the operator can initiate adjustment of the feeder device 14 to the discharge position.

Alternatively, the monitoring of the presence of any particular undesirable material may be carried out visually by the operator controlling the apparatus (without need for provisions of a detector 22), and who would then initiate adjustment of the feeder device to the discharge position when necessary.

The invention also contemplates the provision of a fully automated apparatus, in which the case the detector 22 is arranged to initiate automatic adjustment of the feeder device 14 to the discharge position whenever the presence of undesired material is detected. The feeder device 14 will then be automatically returnable to its operative position when no further undesired material is present.

The feeder device 14 comprises an inlet hopper 15 at one end, and an endless conveyor 17 for conveying material from the hopper 15 to the outlet end 16 of the feeder device 14. In the operative position of the feeder device 14 shown in FIGS. 1 to 4, the endless conveyor 17 is an elevator which raises the material from its lower receiving end adjacent to the outlet of the hopper 15 to the discharge end 16 from which it falls under gravity into the inlet 12 of the crusher device 11.

The feeder device 14 is mounted on a support platform 19, adjacent to the crusher device 11, and is capable of carrying out slewing movement with respect to the platform 19 to move between its operative position and its discharge position.

The support platform 19 forms part of the frame or chassis 18 of the crusher apparatus 10. In the illustrated embodiment, the feeder device 14 is mounted on the platform 19 via a turntable 20 or slew ring, and as can be seen in particular from FIGS. 6 and 7, the feeder device 14 rotates through approximately 45° from the operative feeding position shown in FIGS. 1 to 4, to the inoperative discharge position of FIGS. 5 and 6, in which a batch of bulk material can be discharged to one side of the apparatus, when undesirable contaminant is detected in the batch.

Figure 9:
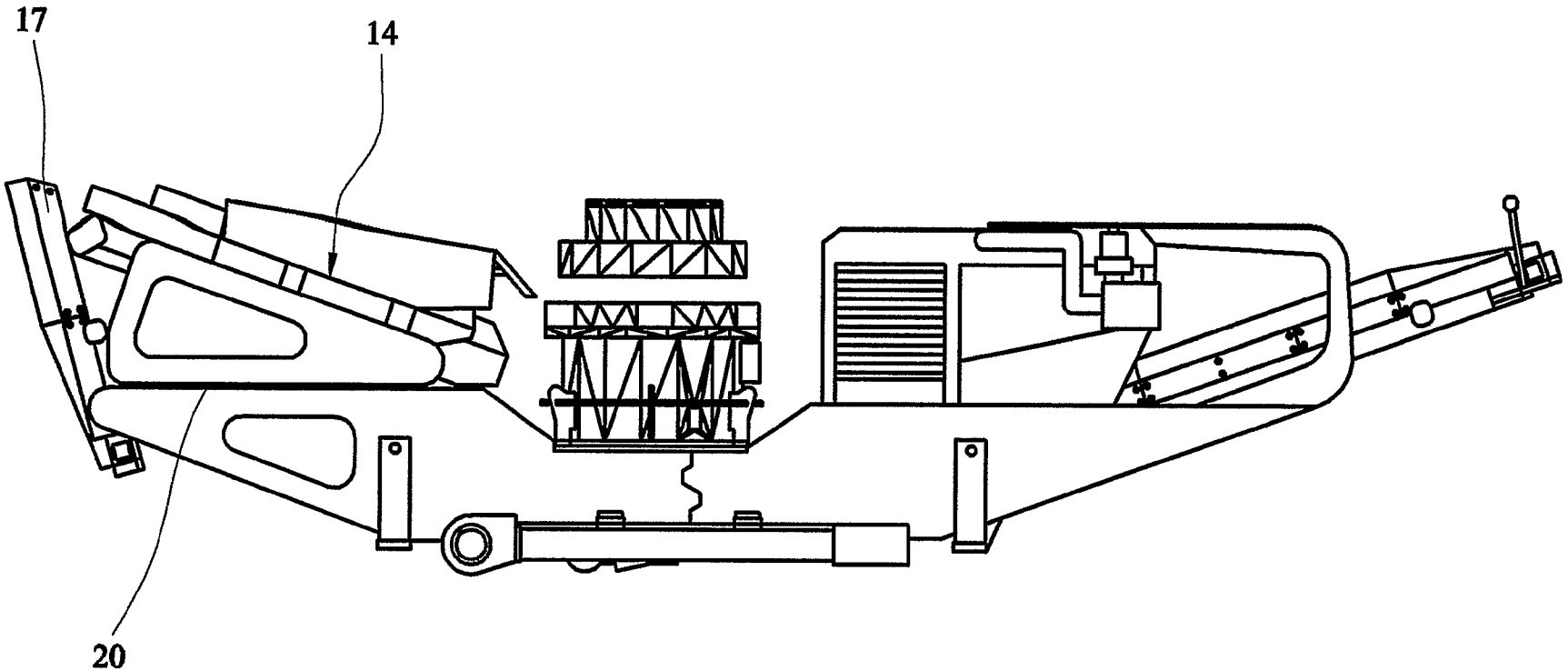
FIG. 9 is a side view of the apparatus, after rotation of the feeder device through approximately 180° to a transport position.
Figure 10:
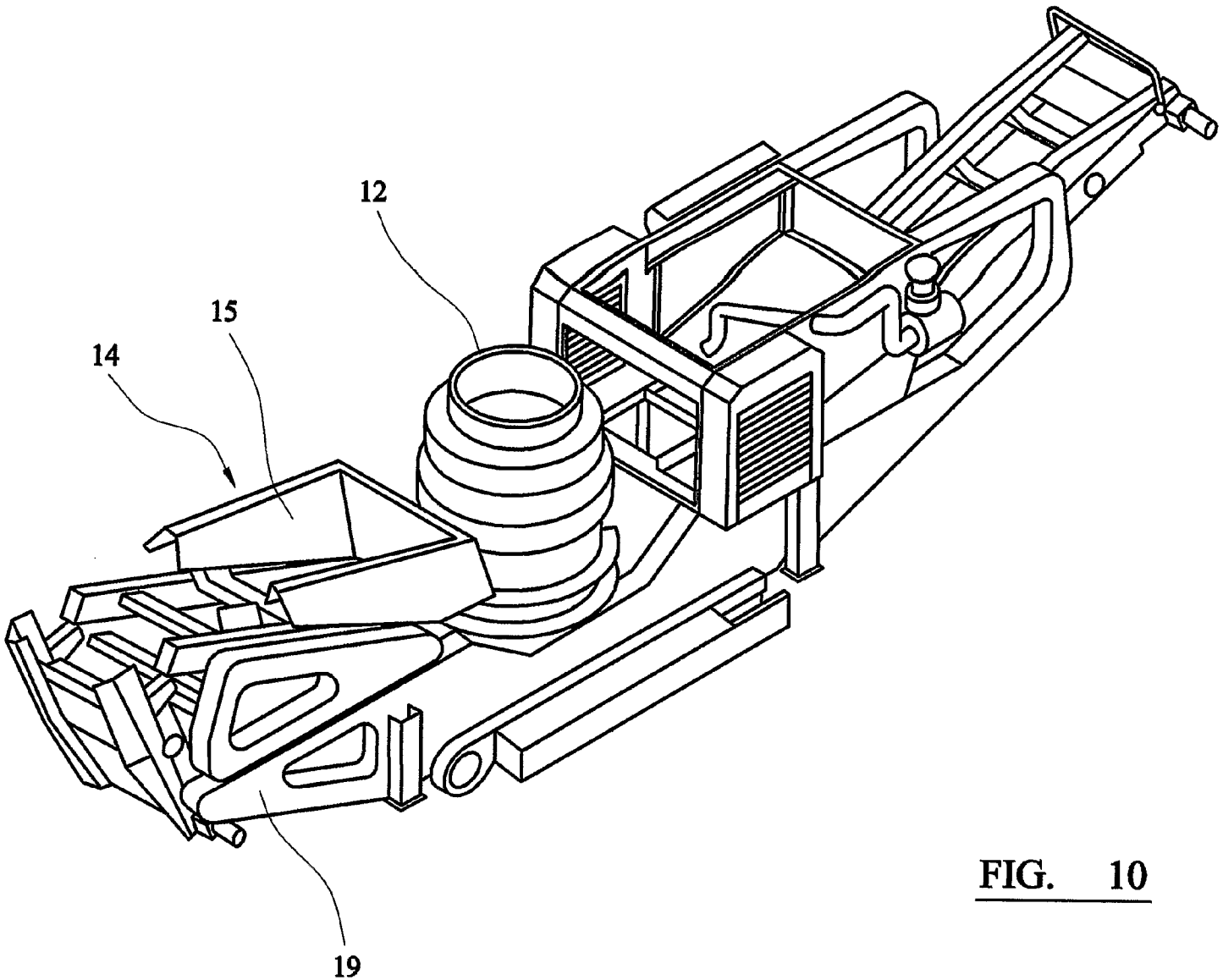
FIG. 10 is a perspective view showing the transport position of the feeder device.

Referring to FIGS. 9 and 10, this shows the apparatus after adjustment to a transport position. The feeder device 14 is rotated through approximately 180° from the operative position to the transport position, and which reduces the overall height of the apparatus. FIGS. 9 and 10 also show the endless conveyor 17 folded downwardly so that it does not project to any appreciable extent lengthwise of the apparatus, thereby reducing the overall length which the apparatus would otherwise take up.

Turning now to the operation of the crusher device 11, the bulk material supplied to the device undergoes crushing action as the material moves downwardly through the crusher device, before issuing from the lower discharge outlet 13. An endless discharge conveyor 21 is arranged to receive and to discharge the crushed material produced by the crusher device and to form a stockpile, or to supply the crushed material into loading vehicles.

It will be noted from the drawings, e.g. FIG. 1 in particular, that the crusher device 11 is located centrally of the frame 18 of the apparatus, and the feeder device 14 is on one side, and the discharge conveyor 21 and other heavy equipment are located on the opposite side of the crusher device 11, to provide a stable arrangement.

The crusher apparatus 10 may be transported to a site in order to provide a static installation. Alternatively, although not shown, if maneuverability on site is required, the apparatus may be provided with endless tracks to allow movement on site.

The invention claimed is:

1. A crusher apparatus which comprises:

a crusher device having an inlet for receiving a supply of crushable bulk material, and an outlet for discharging crushed material; and a feeder device arranged to feed the supply of bulk material to the inlet of the crusher device;

in which the feeder device comprises an endless conveyor having an input end and a discharge end, the conveyor being adjustable between an operative feeding position in which the bulk material can be supplied to the inlet of the crusher device, and an inoperative, discharge position to discharge undesirable material present in the bulk material for supply to the crusher device, without being fed to the crusher device;

wherein the crusher device is stationary with regard to the adjustable conveyor that is capable of movement between the feeding and discharge positions;

wherein the conveyor is mounted on a support platform via a turntable or slew ring, adjacent to the crusher device, and is capable of carrying out slewing movement with respect to the platform and the crusher device to move between its operative position in which the discharge end of the conveyor is aligned to supply material to the inlet of the crusher device and its discharge position in which the discharge end of the conveyor is aligned to discharge material to one side of the crusher device without being fed to the crusher device.

2. Apparatus according to claim 1, in which the feeder device comprises a unitary assembly which is bodily moveable to adjust to the feeder device between its operative position and its discharge position.

3. Apparatus according to claim 1, in which a detector is arranged to monitor the material as it is fed to the inlet of the crusher device, and to detect the presence of any particular undesirable material.

4. Apparatus according to claim 3, in which the detector is arranged to issue a warning signal when the presence of undesired material is detected, so that an operator can initiate adjustment of the feeder device to the discharge position.

5. Apparatus according to claim 3, in which the detector is arranged to initiate automatic adjustment of the feeder device to the discharge position, when the presence of undesired material is detected.

6. Apparatus according to claim 5, in which the feeder device is automatically returnable to its operative position when no further undesired material is present in a particular batch of material.

7. Apparatus according to claim 1, in which the feeder device comprises an inlet hopper at the input end of the conveyor.

8. Apparatus according to claim 7, in which the endless conveyor is an elevator which is operative to raise the material so as to fall under gravity into the inlet of the crusher device.

9. Apparatus according to claim 1, in which the support platform forms part of the frame or chassis of the crusher apparatus.

10. Apparatus according to claim 1 in which the feeder device is rotatable through approximately 180° from the operative position to a transport position.

11. Apparatus according to claim 10 in which the feeder device comprises an inlet hopper at the input end of the conveyor and in which the conveyor is foldable downwardly when the feeder device has been rotated to the transport position, so that the conveyor does not project lengthwise of the apparatus.

12. Apparatus according to claim 1, in which a discharge conveyor is arranged to receive and to discharge crushed material produced by the crusher device.

13. Apparatus according to claim 12, in which the feeder device comprises an inlet hopper at one end, and an endless conveyor for conveying material from the hopper to the outlet end of the feeder device and in which the endless conveyor of the feeder device, and the discharge conveyor, are located on opposite sides of the crusher device.

* * * * *